US005141704A

United States Patent [19]

Kondo et al.

[11] Patent Number: 5,141,704

[45] Date of Patent: Aug. 25, 1992

[54] NICKEL-CHROMIUM-TUNGSTEN BASE SUPERALLOY

[75] Inventors: Tatsuo Kondo; Hajime Nakajima; Masami Shindo; Hirokazu Tsuji, all of Ibaraki; Ryohei Tanaka, Kanagawa; Susumu Isobe, Aichi; Sadao Ohta, Hyogo; Rikizo Watanabe, Shimane, all of Japan

[73] Assignee: Japan Atomic Energy Res. Institute, Tokyo, Japan

[21] Appl. No.: 737,909

[22] Filed: Jul. 26, 1991

Related U.S. Application Data

[63] Continuation of Ser. No. 448,863, Dec. 12, 1989, abandoned.

[30] Foreign Application Priority Data

Dec. 27, 1988 [JP] Japan ..... 63-330263

[51] Int. Cl.[5] ..... C22C 19/05

[52] U.S. Cl. ..... 420/443; 420/448; 148/428

[58] Field of Search ..... 420/443, 448; 148/427, 148/428, 410

[56] References Cited

U.S. PATENT DOCUMENTS 4,006,015 2/1977 Watanabe et al. ..... 420/448

*Primary Examiner*—R. Dean
*Assistant Examiner*—Margery S. Phipps
*Attorney, Agent, or Firm*—Banner, Birch, McKie & Beckett

[57] ABSTRACT

The improved superalloy that possesses all the characteristics required of the high-temperature structural material of high-temperature gas-cooled reactors (i.e., high-temperature strength, corrosion resistance, good productibility, good hot workability and resistance to embrittlement due to thermal aging) consists essentially of 16–28% Cr. 15–24% W (provided that $Cr+W=39-44\%$), 0.01–0.1% Zr, 0.001–0.015% Y, 0.0005–0.01% B, up to 0.05% C, up to 0.1% Si, up to 0.1% Mn (provided that $Si+Mn \geqq 0.1\%$), up to 0.1% Ti, up to 0.1% Al and up to 0.1% Nb (provided that $Ti+Al \geqq 0.1\%$ and $Ti+Al+Nb \geqq 0.15\%$), with the balance being Ni and inevitable impurities and all percentages being on a weight basis.

1 Claim, 1 Drawing Sheet

(X50)

(X50)

NICKEL-CHROMIUM-TUNGSTEN BASE SUPERALLOY

This application is a continuation of application Ser. No. 448,863, filed Dec. 12, 1989.

BACKGROUND OF THE INVENTION

Field of the Invention

The present invention relates to a Ni-Cr-W superalloy that simultaneously satisfies the requirements for high-temperature strength, corrosion resistance, good producibility, good hot workability and resistance to embrittlement due to thermal aging and which hence is particularly suitable for use as the high-temperature structural material of high-temperature gas-cooled reactors.

Prior Art

Several Ni-Cr-W, Ni-Cr-Fe-Mo and Ni-Cr-W-Mo base alloys have been developed for use as high-temperature structural materials of high-temperature gas-cooled reactors and alloys are known by various names such as Ni-Cr-W alloys, Ni-base superalloys, forgeable Ni-base superalloys, heat-resistant alloys for welding structures and high-temperature corrosion-resistant Ni-base alloys. None of the alloys, however, has been proposed so far simultaneously satisfy the requirements for high-temperature strength and corrosion resistance (the term "corrosion resistance" as used herein means not only resistance to corrosion in a strongly oxidative atmosphere such as air atmosphere but also resistance to corrosion in a weakly oxidative atmosphere such as helium containing trace impurities as exemplified by the primary coolant used in high-temperature gas-cooled reactors), and many prior art alloys achieve high-temperature strength at the sacrifice of corrosion resistance (in particular, resistance to corrosion in helium). On the other hand, alloys having superior corrosion resistance are poor in the high-temperature strength characteristic.

SUMMARY OF THE INVENTION

An object, therefore, of the present invention is to provide a superalloy that possesses all the characteristics required of the high-temperature structural material of high-temperature gas-cooled reactors (i.e., high-temperature strength, corrosion resistance, good producibility, good hot workability and resistance to embrittlement due to thermal aging) and in the alloy these characteristics are exhibited in a balanced way.

This object of the present invention can be attained by an alloy consisting essentially of 16–28% Cr, 15–24% W (provided that $Cr+W=39–44\%$), 0.01–0.1% Zr, 0.001–0.015% Y, 0.0005–0.01% B, up to 0.05% C, up to 0.1% Si, up to 0.1% Mn (provided that $Si+Mn \geqq 0.1\%$), up to 0.1% Ti, up to 0.1% Al and up to 0.1% Nb (provided that $Ti+Al \geqq 0.1\%$ and $Ti+Al+Nb \geqq 0.15\%$), with the balance being Ni and inevitable impurities and all percentages being on a weight basis.

The composition of the alloy of the present invention is related to its characteristics (i.e., high-temperature strength, corrosion resistance, good producibility, good hot workability and resistance to embrittlement due to thermal aging) as summarized below.

HIGH-TEMPERATURE STRENGTH

The higher contents of W and Cr contribute to the solid solution strengthening of the alloy matrix, as well as to the precipitation hardening effect of the $\alpha_2$-W phase (hereinafter referred to simply as the $\alpha_2$ phase). The high-temperature strength of the alloy is further enhanced by the addition of Zr and B and by limiting the contents of Mn and Si so they do not exceed certain levels.

CORROSION RESISTANCE

The corrosion resistance of the alloy is enhanced by adjustment of the Cr content and by the addition of Y. Further improvement is achieved by limiting the contents of Ti, Al and Nb so they do not exceed certain levels.

PRODUCIBILITY AND HOT WORKABILITY

These properties are improved by restricting the upper limit of the W content, by the addition of Y and by limiting the contents of Si and Mn so they do not exceed certain levels.

RESISTANCE TO EMBRITTLEMENT DUE TO THERMAL AGING

The sensitivity of the alloy to embrittlement due to thermal aging is reduced by limiting the contents of C and Ti so they do not exceed certain levels.

DETAILED DESCRIPTION OF THE INVENTION

Figure 1:
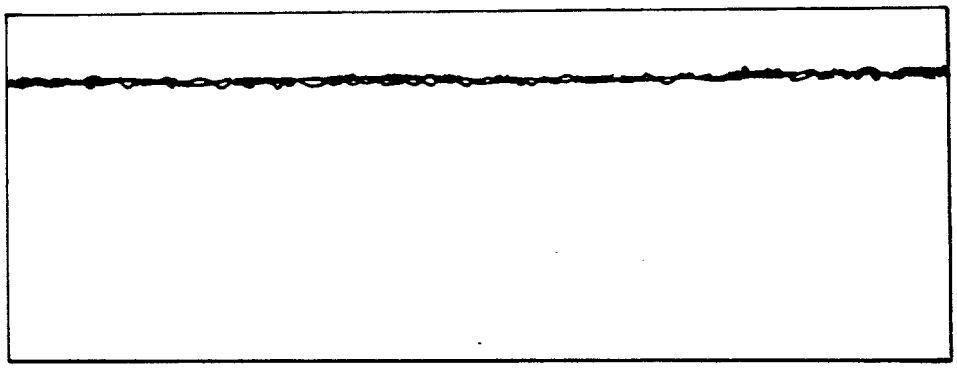
FIG. 1(*a*) is a cross-sectional micrograph of an alloy of the present invention after heating in helium at 1000° C. for 1000 hours; and FIG. (*b*) is a cross-sectional one of a reference alloy after heating in helium at 1000° C. for 1000 hours.
Figure 1:
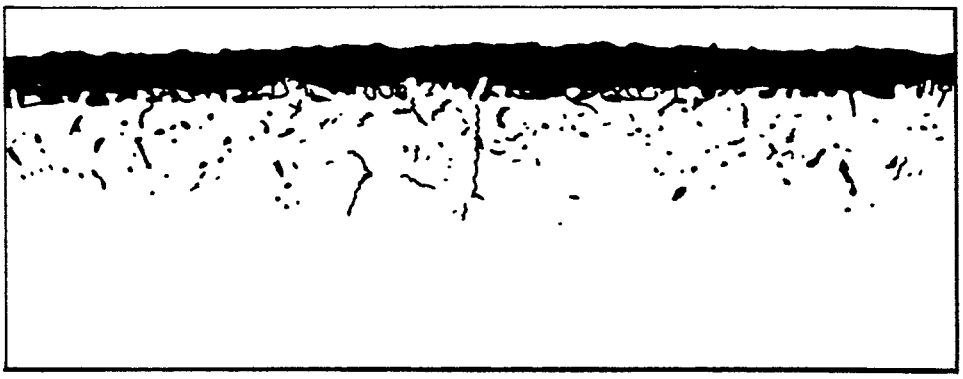

The intention of the contents of each element in the Ni-Cr-W superalloy of the present invention is described below.

(1) Cr and W

Chromium is a beneficial element in achieving solid solution strengthening but it is less effective than tungsten, so its content is determined primarily from the viewpoint of corrosion resistance. The W content is determined primarily from the viewpoints of high-temperature strength and producibility (including hot workability). Furthermore, the sum of Cr and W is determined in order to insure the precipitation of the $\alpha_2$ phase which is a substantial strengthening mechanism for the alloy of the present invention. The sum of Cr and W is limited to lie within the range of 39–44% where the precipitation of the $\alpha_2$ phase occurs. If the W content is more than 24%, the producibility is spoiled. If the W content is less than 15%, significant improvement in strength by solid solution strengthening is not attainable. The W content, therefore, is limited to the range of 15–24%. If the Cr content is les than 16%, resistance to corrosion in strongly oxidative atmospheres is spoiled. If the Cr content exceeds 28%, resistance to corrosion in weakly oxidative atmospheres such as helium used as the primary coolant in high-temperature gas-cooled reactors is spoiled. The Cr content, therefore, is limited to the range of 16–28%.

(2) Zr and B

Adding 0.01-0.1% Zr and 0.0005-0.01% B will contribute to an improvement in creep strength and tensile ductility. Such properties, however, will not be improved substantially if the Zr and B contents are less than 0.01% and 0.0005%, respectively. Weldability is reduced if Zr and B are added in amounts exceeding 0.1% and 0.01%, respectively.

(3) Y

Adding 0.001-0.015% Y will contribute to an improvement in corrosion resistance and hot workability. Such properties, however, will not be improved appreciably if Y is added in amounts less than 0.001%. Creep strength and weldability are spoiled if Y is added in amounts exceeding 0.015%.

(4) C

Carbon is an element with which one usually expects precipitation hardening by carbides. But, depending on the composition of helium used as the primary coolant in high-temperature gas-cooled reactors, decarburization may take place and the alloy strengthened by carbides will experience a significant reduction in strength upon decarburization. Furthermore, precipitation hardening by carbides has the potential hazard of increasing sensitivity to embrittlement due to thermal aging. In the alloy of the present invention, therefore, the C content is held to the lowest possible level which does not exceed 0.05%.

(5) Si and Mn

Addition of Si and Mn contributes to an improvement of resistance to corrosion in helium but reduces hot workability and creep strength. As already mentioned, however, resistance to corrosion in helium can also be improved by addition of Y. Thus, in order to improve hot workability and creep strength, the contents of Mn and Si must be held to the lowest possible levels. Each of Si and Mn, taken individually, is limited to be no more than 0.1%. If both elements are to be added, the sum should not exceed 0.1%.

(6) Ti, Al and Nb

These elements are detrimental to corrosion resistance. In particular, Ti and Al promote selective oxidation along the grain boundaries. Furthermore, Ti enhances sensitivity to embrittlement due to thermal aging. The contents of Ti, Al and Nb, therefore, must be held to the lowest possible levels. Each of these elements, when taken individually, is limited to be no more than 0.1%. If all of them are to be added, the sum should not exceed 0.15%.

DETAILED DESCRIPTION OF THE PREFERRED EMBODIMENT:

The present invention is described below in more detail with reference to samples of the alloy of the present invention and reference samples.

Starting materials were mixed in such proportions as to provide the final chemical compositions shown in Table 1. The mixed starting materials were melted in a vacuumed induction furnace. The resulting ingots were homogenized and worked into bars by finish-forging at 1120°-1200° C. In this way, alloy samples A-E of the present invention and reference samples F-U were prepared. Reference sample G having the highest W content (27.5%) cracked during forging and its yield (or producibility rate) was low.

On the basis of the results of the preliminary tests conducted to determine the temperature for solution treatment, temperatures suitable for the individual alloys were selected and the alloys were subjected to solution treatment, followed by working into pieces to be subjected to various tests.

The tests conducted were hot workability tests to investigate both producibility and hot workability, tensile tests and creep rupture tests to examine high-temperature strength, and corrosion tests to check corrosion resistance. The results are summarized below seriatim.

(1) Hot Workability Test

Using a high-speed, high-temperature tensile tester operating on resistive heating by direct application of an electric current, the samples were preliminarily heated at 1200° C. for 1 minute, then subjected to hot workability tests in the temperature range of 800° -1300° C. Acceptable hot workability may be indicated by 50% or more reduction of area at fracture portion and the wider the temperature range that provides 50% or more reduction of area fracture portion (i.e., optimum temperature range for hot working), the better the producibility rate and hot workability. The results of the hot workability tests conducted are shown in Table 2. As is clear from this table, the optimum temperature range for hot working was not strongly dependent upon the W content except in reference sample G containing 27.5% W. As for other elements, alloys H, I, J, S and U which did not contain Y, alloys H, R and U containing both Si and Mn (alloys H and U did not contain Y), alloy N containing 0.13% Zr, alloy O containing 0.020% Y and alloy P containing 0.013% B were narrow in the optimum temperature range for hot working compared to the other alloys.

(2) Tensile Test

Tensile tests were conducted at eight different temperatures in the range from room temperature to 1050° C. on all the samples after they were subjected to a solution treatment, and on alloys D and H-Q after they were subjected to a thermal aging treatment at 800° C. for 1000 hours. The general tendency was that the more the W content (the less the Cr content), the higher the strength and the lower the ductility. But, the drop in the ductility of high tungsten alloys could be compensated for by addition of B. The results of the tests conducted on the aged samples are partly shown in Table 2 in terms of tensile elongation at fracture at room temperature after thermal aging at 800° C. for 1000 hours. Alloy M containing 0.061% C and alloys I and Q containing Ti experienced substantial reduction in ductility.

(3) Creep Rupture Test

Creep rupture tests were conducted in air atmosphere at three different temperature, 900° C., 1000° C. and 1050° C. The results are partly shown in Table 2 in terms of creep rupture life under stresses of 53.9 MPa (900° C.), 29.4 MPa (1000° C.) and 19.6 MPa (1050° C.). Alloy F containing the least amount of W (12.8%) and alloy G containing it in the largest amount (27.5%) showed comparatively short creep rupture lives but the lives of the other alloys were almost independent of the W content. As for other elements, alloys J, R and T containing neither Zr nor B, alloys H, R and U containing both Mn and Si (alloy R contained neither Zr nor B) and alloy O containing 0.02% Y showed short rupture lives.

(4) Corrosion Test

Corrosion tests were conducted in both air atmosphere and helium simulating the primary coolant used in high-temperature gas-cooled reactors (He-20 Pa $H_2$-0.1 Pa $H_2O$-10 Pa CO-0.2 Pa $CO_2$-0.5 Pa $CH_4$) at temperatures of 900° C. and 1000° C. for a heating temperature extended up to 1000 hours. In order to expose the samples to severe conditions, accelerated thermal cycles were applied at intervals of 100 hours between test temperatures and room temperature. Table 3 shows the weight gains due to oxidation and the amounts of spalled oxide film after testing in both air atmosphere and helium at 1000° C. for 1000 hours. FIG. 1(*a*) shows a cross-sectional micrograph of alloy sample D of the present invention (0.03% Ti and 0.02% Al), and FIG. 1(*b*) shows a cross-sectional one of reference alloy sample Q (0.3% Ti and 0.2% Al). Both samples had been heated in helium at 1000° C. for 1000 hours. The general tendency observed with heating in air atmosphere was such that as the Cr content decreased, the weight gain due to oxidation and the amount of the spalled oxide film increased. These phenomena were particularly conspicuous in alloy G containing the smallest amount of Cr (11.9%). The general tendency in helium was opposite to that observed with heating in air atmosphere and the weight gain due to oxidation increased with an increasing Cr content. In particular, alloy F having the highest Cr content (30.4%) experienced a greater weight gain than any other alloy, with spallation of the oxide film being also observed. As for other elements, the addition of Y and the combined addition of Mn and Si suppressed the weight gain due to oxidation and the spallation of oxide film, thus demonstrating their effectiveness in improving corrosion resistance. On the other hand, containing Ti and Al and adding Nb were detrimental to corrosion resistance, as evidenced by the increase in weight gain and spallation of the oxide film. In particular, as is clear from FIGS. 1(*a*) and 1(*b*), containing Ti and Al promoted selective oxidation along the grain boudaries and this effect was notable when heating was done in helium.

TABLE 1

| Alloy | | Chemical composition (wt %) | | | | | | | | | | | |
|---|---|---|---|---|---|---|---|---|---|---|---|---|---|
| | | C | Si | Mn | Ni | Cr | W | Ti | Zr | Y | B | Al | Nb |
| Alloys of the present invention | A | 0.018 | 0.02 | 0.01 | bal. | 28.0 | 15.1 | 0.02 | 0.04 | 0.008 | 0.005 | 0.02 | 0.02 |
| | B | 0.021 | 0.04 | 0.02 | bal. | 23.9 | 18.2 | 0.02 | 0.07 | 0.003 | 0.008 | 0.04 | 0.05 |
| | C | 0.017 | 0.03 | 0.03 | bal. | 20.1 | 21.2 | 0.04 | 0.05 | 0.005 | 0.003 | 0.03 | 0.04 |
| | D | 0.024 | 0.01 | 0.04 | bal. | 18.3 | 21.9 | 0.03 | 0.06 | 0.011 | 0.006 | 0.02 | 0.04 |
| | E | 0.030 | 0.05 | 0.01 | bal. | 16.4 | 23.7 | 0.01 | 0.04 | 0.007 | 0.004 | 0.05 | 0.03 |
| Reference alloys | F | 0.025 | 0.02 | 0.03 | bal. | 30.4 | 12.8 | 0.03 | 0.06 | 0.006 | 0.004 | 0.01 | 0.05 |
| | G | 0.018 | 0.01 | 0.02 | bal. | 11.9 | 27.5 | 0.04 | 0.07 | 0.003 | 0.002 | 0.04 | 0.02 |
| | H | 0.022 | 0.26 | 0.88 | bal. | 18.5 | 21.4 | 0.02 | 0.06 | <0.001 | 0.005 | 0.02 | 0.01 |
| | I | 0.031 | 0.04 | 0.05 | bal. | 18.7 | 22.0 | 0.23 | 0.03 | <0.001 | 0.006 | 0.04 | 0.04 |
| | J | 0.026 | 0.06 | 0.03 | bal. | 18.1 | 21.8 | 0.01 | <0.01 | <0.001 | <0.0005 | 0.01 | 0.03 |
| | K | 0.020 | 0.02 | 0.02 | bal. | 19.0 | 21.3 | 0.04 | 0.05 | 0.005 | 0.007 | 0.42 | 0.05 |
| | L | 0.019 | 0.04 | 0.06 | bal. | 18.5 | 21.5 | 0.03 | 0.06 | 0.008 | 0.009 | 0.03 | 0.33 |
| | M | 0.061 | 0.05 | 0.02 | bal. | 18.4 | 21.9 | 0.01 | 0.04 | 0.006 | 0.004 | 0.02 | 0.04 |
| | N | 0.023 | 0.01 | 0.03 | bal. | 18.3 | 21.5 | 0.04 | 0.13 | 0.005 | 0.006 | 0.04 | 0.01 |
| | O | 0.020 | 0.02 | 0.04 | bal. | 18.7 | 22.1 | 0.02 | 0.03 | 0.020 | 0.005 | 0.02 | 0.05 |
| | P | 0.022 | 0.03 | 0.05 | bal. | 18.2 | 21.8 | 0.03 | 0.05 | 0.008 | 0.013 | 0.04 | 0.02 |
| | Q | 0.030 | 0.01 | 0.02 | bal. | 18.9 | 21.9 | 0.30 | 0.06 | 0.009 | 0.006 | 0.20 | 0.04 |
| | R | 0.019 | 0.30 | 0.52 | bal. | 27.6 | 15.2 | 0.04 | <0.01 | 0.006 | <0.0005 | 0.01 | 0.02 |
| | S | 0.055 | 0.02 | 0.04 | bal. | 27.4 | 15.6 | 0.22 | 0.05 | <0.001 | 0.004 | 0.03 | 0.04 |
| | T | 0.021 | 0.04 | 0.03 | bal. | 16.1 | 24.0 | 0.02 | <0.01 | 0.003 | <0.0005 | 0.04 | 0.03 |
| | U | 0.071 | 0.34 | 0.46 | bal. | 15.9 | 23.7 | 0.28 | 0.04 | <0.001 | 0.003 | 0.03 | 0.02 |

TABLE 2

| Alloy | | Optimum temperature range for hot working (°C.) | Tensile elongation at fracture at R.T. after thermal aging (%) | Creep rupture life (hours) | | |
|---|---|---|---|---|---|---|
| | | | | 900° C. 53.9 MPa | 1000° C. 29.4 MPa | 1050° C. 19.6 MPa |
| Alloys of the present invention | A | 800–1280 | — | 1005 | 1752 | 820 |
| | B | 800–1270 | — | 1102 | 1802 | 852 |
| | C | 800–1280 | — | 1035 | 1799 | 831 |
| | D | 800–1270 | 35 | 1056 | 1860 | 849 |
| | E | 800–1260 | — | 1110 | 1800 | 846 |
| Reference alloys | F | 800–1280 | — | 579 | 490 | 341 |
| | G | 1150–1250 | — | 745 | 843 | 476 |
| | H | 1140–1250 | 32 | 864 | 1130 | 606 |
| | I | 1080–1260 | 9 | 1023 | 1760 | 831 |
| | J | 1090–1260 | 27 | 823 | 1203 | 599 |
| | K | 800–1270 | 34 | 1089 | 1799 | 856 |
| | L | 800–1260 | 31 | 1008 | 1623 | 769 |
| | M | 800–1270 | 11 | 1001 | 1697 | 809 |
| | N | 1130–1250 | 30 | 1046 | 1743 | 822 |
| | O | 1150–1250 | 33 | 784 | 1078 | 508 |
| | P | 1140–1250 | 34 | 999 | 1807 | 876 |
| | Q | 800–1260 | 8 | 1023 | 1782 | 841 |
| | R | 1050–1260 | — | 678 | 1249 | 490 |
| | S | 1050–1260 | — | 1011 | 1769 | 836 |
| | T | 800–1250 | — | 845 | 1280 | 621 |

TABLE 2-continued

| Alloy | | Optimum temperature range for hot working (°C.) | Tensile elongation at fracture at R.T. after thermal aging (%) | Creep rupture life (hours) 900° C. 53.9 MPa | 1000° C. 29.4 MPa | 1050° C. 19.6 MPa |
|---|---|---|---|---|---|---|
| | U | 1160–1250 | — | 794 | 1104 | 582 |

TABLE 3

| Alloy | | 1000° C. × 1000 hours in air: Weight gain due to oxidation (mg/cm²) | Spalled oxide film (mg/cm²) | 1000° C. × 1000 hours in helium: Weight gain due to oxidation (mg/cm²) | Spalled oxide film (mg/cm²) |
|---|---|---|---|---|---|
| Alloys of the present invention | A | 1.0 | 0.1 | 1.1 | 0.0 |
| | B | 1.2 | 0.3 | 1.0 | 0.0 |
| | C | 1.3 | 0.4 | 1.0 | 0.0 |
| | D | 1.3 | 0.4 | 0.8 | 0.0 |
| | E | 1.5 | 0.5 | 0.8 | 0.0 |
| Reference alloys | F | 0.8 | 0.1 | 1.5 | 0.3 |
| | G | 2.0 | 1.4 | 0.6 | 0.0 |
| | H | 1.2 | 0.3 | 0.9 | 0.0 |
| | I | 2.4 | 2.0 | 2.4 | 0.9 |
| | J | 2.1 | 1.5 | 1.8 | 0.5 |
| | K | 1.9 | 0.9 | 1.6 | 0.4 |
| | L | 2.0 | 1.1 | 1.9 | 0.6 |
| | M | 1.4 | 0.5 | 0.8 | 0.0 |
| | N | 1.5 | 0.4 | 0.9 | 0.0 |
| | O | 1.3 | 0.3 | 0.7 | 0.0 |
| | P | 1.4 | 0.4 | 0.9 | 0.0 |
| | Q | 2.2 | 1.3 | 1.9 | 0.5 |
| | R | 1.1 | 0.1 | 1.1 | 0.0 |
| | S | 1.7 | 0.5 | 2.6 | 1.1 |
| | T | 1.6 | 0.5 | 0.8 | 0.0 |
| | U | 1.6 | 0.6 | 1.9 | 1.0 |

As will be understood from the foregoing description, the present invention provides a superalloy that possesses all the characteristics required of the high-temperature structural material of high-temperature gas-cooled reactors (i.e., high-temperature strength, corrosion resistance, good producibility, good hot workability and resistance to embrittlement due to thermal aging) and in the alloy these characteristics are exhibited in a balanced way.

While the present invention has been described above with reference to particularly preferred embodiments, the invention is by no means limited to these particular embodiments and it will be readily understood by one skilled in the art that various modifications and improvements can be made without departing from the spirit and scope of the present invention.

What is claimed is:

1. A Ni-Cr-W base superalloy containing Zr, Y, B, C, Si, Mn, Ti, Al, and Nb, wherein said superalloy consists essentially of 16 to 28% Cr, 15 to 24% W wherein the total content of Cr+W=39 to 44%, 0.01 to 0.1% Zr, 0.001 to 0.015% Y, 0.0005 to 0.01% B, up to 0.05% C, up to 0.1% Si, up to 0.1% Mn, wherein the total content of Si+Mn≦0.1%, up to 0.1% ti, from about 0.02% to about 0.05% Al and up to 0.1% Nb, wherein the total content of Ti+Al≦0.15%, with the balance being Ni and inevitable impurities and all percentages being on a weight basis.

* * * * *